US006708627B1

(12) United States Patent
Wood

(10) Patent No.: US 6,708,627 B1
(45) Date of Patent: Mar. 23, 2004

(54) SHELF SECTION AND METHOD

(76) Inventor: Harry A. Wood, P.O. Box 1247, Snohomish, WA (US) 98291

( * ) Notice: Subject to any disclaimer, the term of this patent is extended or adjusted under 35 U.S.C. 154(b) by 0 days.

(21) Appl. No.: 09/940,274

(22) Filed: Aug. 27, 2001

Related U.S. Application Data

(60) Provisional application No. 60/228,077, filed on Aug. 25, 2000.

(51) Int. Cl.[7] ..... A47B 37/00

(52) U.S. Cl. ..... 108/42; 211/135

(58) Field of Search ..... 211/90.01, 90.02, 211/153, 135; 108/42; 248/248

(56) References Cited

U.S. PATENT DOCUMENTS

| | | | | |
|---|---|---|---|---|
| 498,563 | A | 5/1893 | Montgillion | |
| 617,164 | A | 1/1899 | Jewett | |
| 1,098,227 | A | 5/1914 | Casper | |
| 1,270,718 | A * | 6/1918 | Ford | 105/425 |
| 2,465,635 | A | 3/1949 | Conterio | |
| 2,527,253 | A | 10/1950 | Hedfield et al. | |
| 2,720,316 | A | 10/1955 | Glascott | |
| 2,849,123 | A | 8/1958 | Magill | |
| 2,994,114 | A | 8/1961 | Black | |
| 3,698,329 | A | 10/1972 | Diamond et al. | |
| 4,064,992 | A | 12/1977 | Ralson et al. | |
| 4,155,312 | A | 5/1979 | Thorkildson | |
| D281,040 | S | 10/1985 | Campbell et al. | |
| 4,804,094 | A | 2/1989 | Eittreim | |
| 5,617,797 | A | 4/1997 | Casey | |
| 6,102,217 | A | 8/2000 | Mathy et al. | |

* cited by examiner

*Primary Examiner*—Lanna Mai
*Assistant Examiner*—Jerry A. Anderson
(74) *Attorney, Agent, or Firm*—Michael F. Hughes; Hughes Law Firm, PLLC

(57) ABSTRACT

A shelf section adapted to fit against a wall section where there are exposed 2×4 wooden posts at spaced intervals. The shelf section has a horizontal platform, part of which is positioned between adjacent 2×4 posts, and the other part extending outwardly from the posts. A pair of mounting flanges attach to the outer surfaces of the 2×4s, and a pair of braces extend between the flanges and the platform. The shelf section is designed to be made from a single metal sheet cut to the appropriate dimensions and configuration, and is arranged so that a plurality of shelf sections can next within one another for storage, transportation, etc.

7 Claims, 8 Drawing Sheets

SHELF SECTION AND METHOD

This application claims the benefit of provisional application No. 60/228,077, filed Aug. 25, 2000.

BACKGROUND OF THE INVENTION (a) Field of the Invention

The present invention relates to shelving, such as small shelf sections which can conveniently be mounted to various structures, and more particularly to a shelving system where individual shelving sections can be conveniently mounted to particular structural configurations where they are exposed vertical posts at spaced intervals.

(b) Background Art

It is quite common in housing structures (or other structures) to construct walls or other structural section where there are spaced, vertically aligned wooden 2×4s or 2×6s. These are commonly covered with panels, such as plasterboard. However, in some instances these vertical wooden posts, while having wall panels on one side, are otherwise exposed. This would commonly happen, for example, where there is a shop, tool shed, or garage where the interior wall surfaces do not have panels, but have the exposed 2×4s.

In those situations, it is often desired to have shelving for storage of various items. However, conventional shelving comprising long planks has the obvious drawback that the shelving would be positioned entirely outwardly from the outer surface of the 2×4s, and there would be an empty area between the rear part of the shelving and the panel that is connected to the opposite surfaces of the 2×4s. Accordingly, it is an object of the present invention to provide a shelving system where the individual shelf sections could be conveniently and economically manufactured, and also be used quite conveniently in situations such as described above.

SUMMARY OF THE INVENTION

The present invention relates to a shelf section which is particularly adapted to be connected to two posts which are spaced laterally from one another. The present invention can quite advantageously be used in a situation, for example, where there is a wall structure made up of a plurality of vertical wooden 2×4s which are space laterally from one another at a spacing distance of, for example, sixteen or eighteen inches. At least one side of the array of 2×4s would be exposed (i.e. would not have sheet rock paneling or other paneling covering the 2×4s), and the other surface of the array of 2×4s may or may not have paneling covering the same. This commonly occurs, for example, in the interior walls of a garage, a shop, a tool shed, or the like.

The shelf section can quite advantageously be made as an integral structure, and more specifically be formed from a planar piece of sheet metal cut to the proper configuration and dimensions. Then the sheet metal is bent along designated bend lines to form the finished product which is the shelf section.

The shelf section has a platform with front and rear platform edge portions and oppositely positioned side platform edge portions. There is a front-to-rear longitudinal axis, and a transverse axis. The platform is arranged so that in an operating position (e.g. mounted between the adjacent posts) at least a portion of the platform is positioned between the two posts.

The shelf section has a pair of mounting flanges located on opposite sides of the shelf section and positioned in a manner that with this shelf section in the operating position, the mounting flanges are located so as to be adjacent to the respective front surfaces of the posts so as to be able to be connected thereto (e.g. by screws).

Then there is a pair of bracing members located on opposite sides of each platform, which each bracing member connecting between a related flange and a forward edge portion of the platform.

In a preferred configuration, a forward portion of the platform has front side edges which extend in a forward and inward direction toward the longitudinal center axis, and the two bracing members are each attached to the converging forward side edge portions of the platform, extending upwardly therefrom and joined to the related flange members. This enables a plurality of the shelf members to be stacked together in nesting relationship with related forward portions of the shelf members nesting within one another, and the platforms positioned on top of one another but shifted from one another in the stacking configuration.

In the "laid-flat" configuration of the shelf member (its pre-form condition from which is to be formed into the shelf section), there are pre-designated bend lines between the two bracing members in the platform, and also two bracing lines corresponding to connecting lines between the two bracing members and the two flange members. During the bending operation, the flange members are bent along their bending lines about ninety degrees, and the bracing members are bent along their bending lines ninety degrees to be formed into the configuration of the finished product.

Also within the scope of the present invention is the method of forming the individual shelf sections, and also in forming the shelf sections in a mass-production operation where these are formed at forming/cutting stations. Also, the present invention relates to the method of using the shelf section of the present invention. Other features of the present invention will become apparent from the following detailed description.

BRIEF DESCRIPTION OF THE DRAWINGS

FIG. 8 is a plan view, partly in section, similar to FIG. 7, and showing a larger shelf section, having a greater depth dimension than the shelf section, and mounted between two 2×6 wooden posts, indicated at;

DESCRIPTION OF THE PREFERRED EMBODIMENTS

Figure 1:
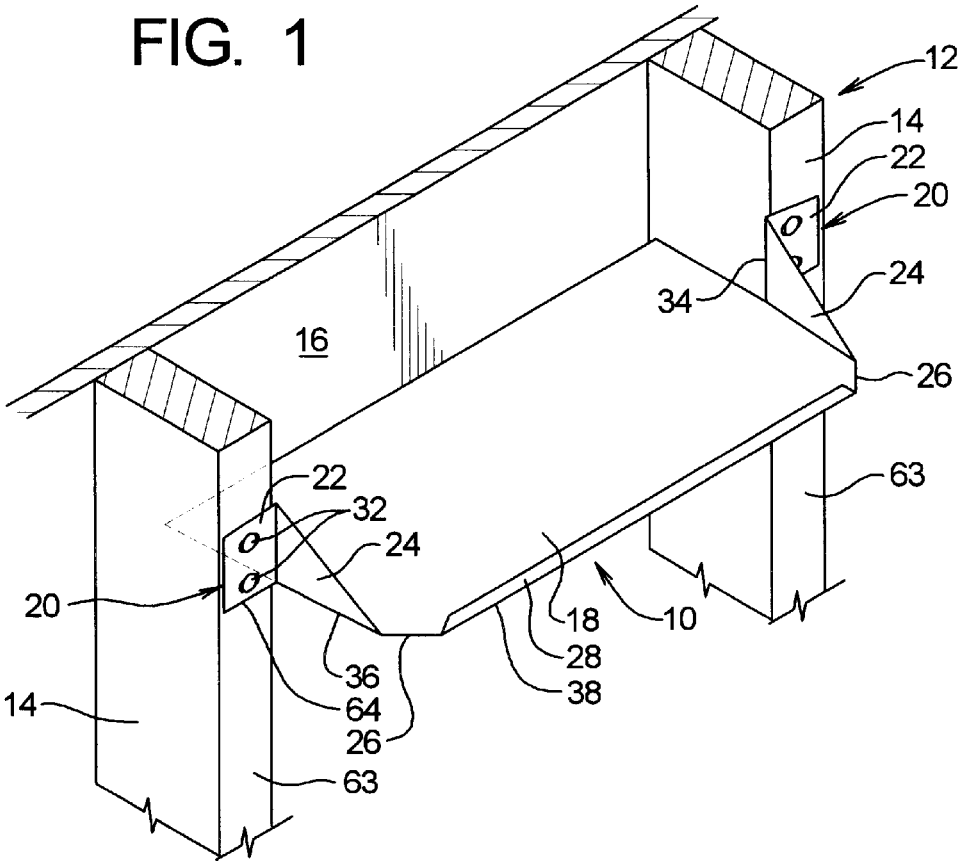
FIG. 1 is an isometric view of the shelf section mounted to two vertical 2×4s, by means of mounting flanges.
Figure 2:
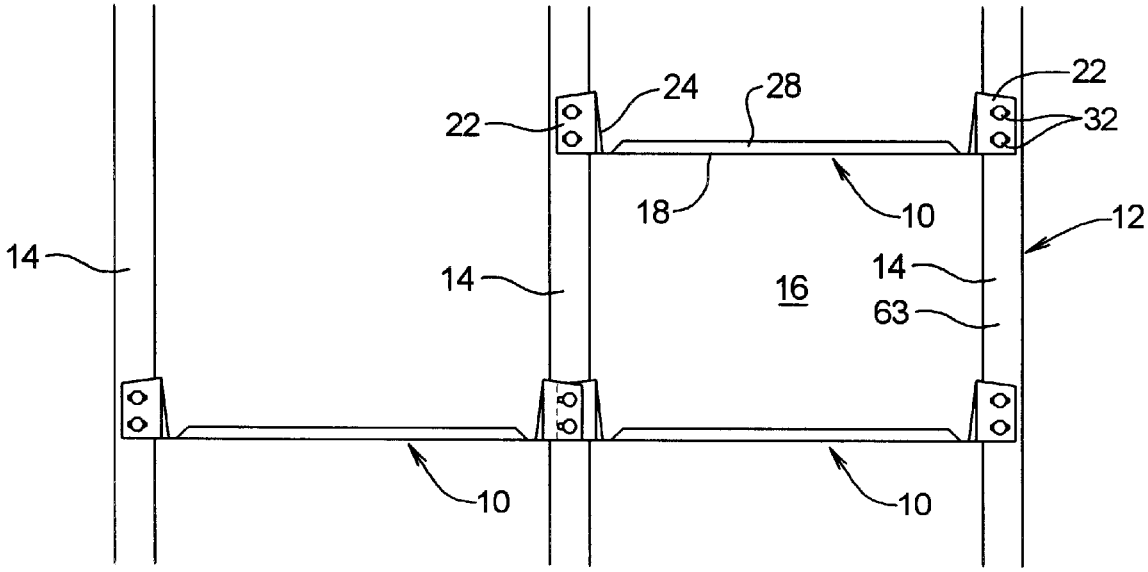
FIG. 2 is a front elevational view showing three of the shelf sections mounted to three adjacent 2×4s.

To describe the first embodiment of the present invention, reference is first made to FIG. 1 which shows the shelf section 10 of the present invention mounted to a structure 12, comprising two vertical posts 14 of a rectangular cross-section (in this preferred embodiment, two wooden 2×4s) and a back wall 16. The shelf section 10 comprises a horizontal platform 18 which in turn is supported by two side mounting sections 20. Each mounting section 20 comprises a mounting flange 22 connected to a related 2×4 post 14, and a triangular bracing member 24 connected between its related flange 22 and a forward side edge portion of the platform 18. The two forward corner portions of the platform 18 are beveled at 26, and the forward edge of the platform 18 is formed as an upturned lip 28 extending between the beveled corners 26. Each of the flanges 22 has two horizontal mounting slots 30 spaced vertically from one another, and screws 32 are inserted through related slots 30 and into the related 2×4 post (see FIG. 7).

Figure 6:
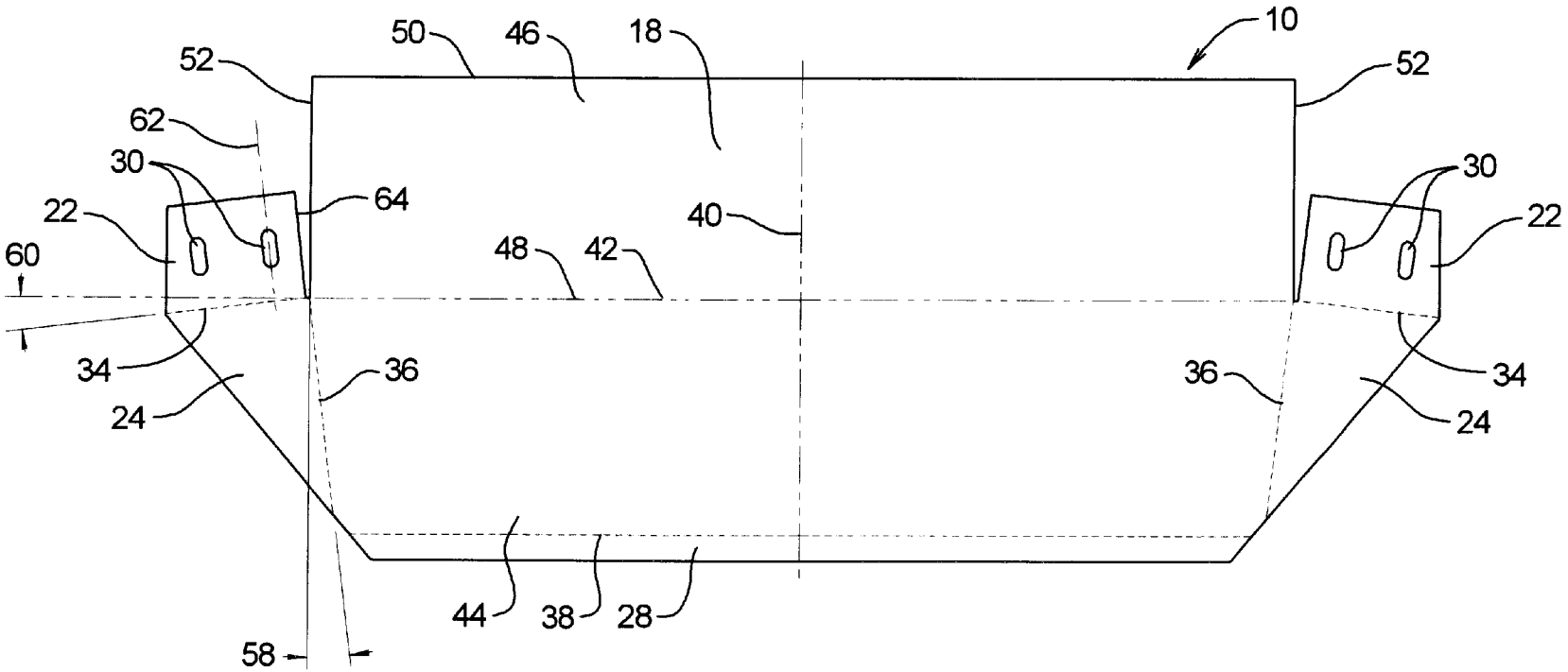
FIG. 6 is a top plan view of the single shelf section in a "laid-flat" configuration, and illustrating the bend lines along which the piece of sheet metal is bent to form the finished shelf section of FIGS. 1, 2, and 3, and showing also the angular relationships of these bend lines.

In continuing this description of this first embodiment, it is believed that a better understanding will be provided by the reader viewing FIG. 6. One of the benefits of this first embodiment is that it can be made as one integral piece which is manufactured from flat sheet metal stock and bent along bend lines. This not only provides structural benefits in the way of structural strength, but also enables the panel section 10 to be manufactured efficiently and economically.

FIG. 6 is a plan view looking on a laid-flat piece of sheet metal which has been cut to the appropriate shape and dimensions to be formed into the panel section 10 of FIG. 1. For ease of description, the numerical designations which are used in the descriptions given thus far with reference to FIG. 1 will be used in describing this laid-flat version of FIG. 6. Also, the numerical designations which are given in the following text to the bend lines in describing FIG. 6 will be used in designating these bend line locations in the finished panel section 10, with the understanding that these bend lines are the juncture lines where the platform 18, flanges 22, bracing members 34, and the front lip 28 are joined. In FIG. 6, the bend lines are shown as broken lines, and it can be seen that there are five bend lines, namely two bend lines 34, two bend lines 36, and a single bend line 38.

Each of the two bend lines 34 connects a related flange member 22 to its related bracing member 24. Each bend line 36 connects its related bracing member 24 to a forward edge portion of the platform 18. The single bend line 38 joins the front lip 28 to the platform 18.

Continuing this description with reference to FIG. 6, the "laid-flat" panel section 10 of FIG. 6 has a forward-to-rear longitudinal center axis 40, and a transverse axis 42 which, for purposes of future reference, is indicated as passing through two side points which are defined by the intersection of each pair of adjacent pairs of bend lines 34 and 36.

It is readily apparent from viewing FIG. 6 and FIG. 1 that the bending of the "laid-flat" panel section 10 to form the finished panel section 10 of FIG. 1 is accomplished by bending each of the flanges 22 in a downward direction ninety degrees (as viewed in FIG. 6) and bending each of the bracing members 24 upwardly ninety degrees (i.e. upwardly from the paper surface as shown in FIG. 6). Then the front lip 28 is bent upwardly (as seen in the plan view of FIG. 6) along the bend line 38.

The angular disposition of the bend lines 34 and 36 are significant in the present invention. In describing these, it should first be noted that the platform 18 can be considered as having a forward section 44 and a rear section 46, with the dividing line 48 of these forward and rear sections 44 and 46 being located at the transverse axis 42 (thus, the same line in FIG. 6 is given two designations, one designation 42 relating to its function as a transverse axis, and the other designation 48 relating to its function as a "boundary line" between the forward and rear platform sections 44 and 46).

Figure 3:
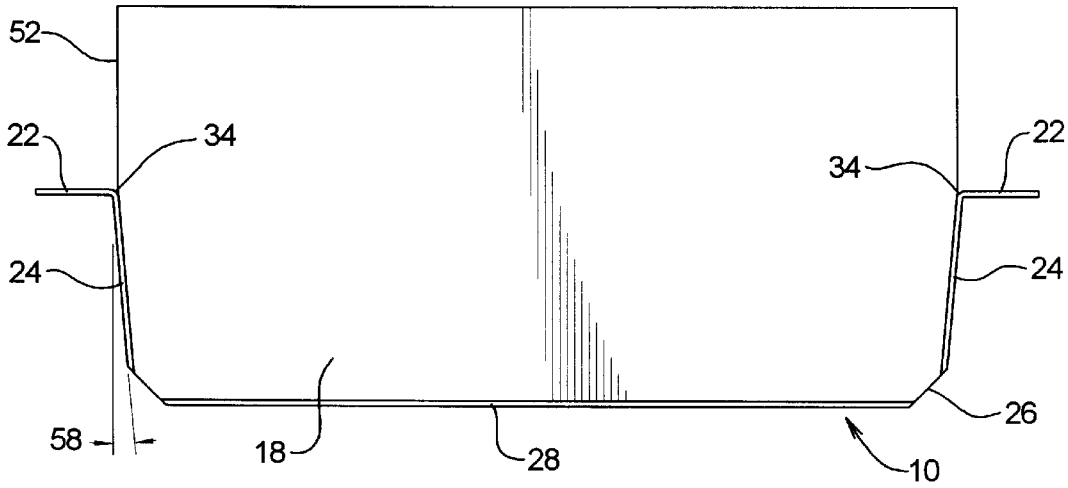
FIG. 3 is a top plan view of the first embodiment of the present invention, but without being mounted to a structure.

The rear panel section 46 has a rear edge 50 which is parallel to the axis 42 and two rear side edge portions 52 which are parallel to one another and perpendicular to the rear edge 50 and to the transverse axis 48. Relating this back to FIG. 1 (and also to FIGS. 3 & 7), it can be seen that the lateral spacing distance between the two rear side edge portions 52 is just slightly less than the spacing distance between the lateral adjacent surfaces 52 of the 2×4 posts 14. Thus, with the panel section 10 being in its functioning position of FIGS. 1 and 7, there is a small gap 56 formed between each pair of edge portions 52 and side surfaces 54, to compensate for any possible inaccuracies in the spacing of the 2×4 posts 14 or possible misalignment of the same.

Now let us turn our attention back to the alignment of the bend lines 34 and 36. In looking at the left-hand side of FIG. 6, it can be seen that each bend line 36 has a slight forward and inward slant at an angle (indicated at 58) of approximately six degrees. Then each bend line 34 is perpendicular to its adjacent bend line 36 and thus makes an angle (indicated at 60) of six degrees relative to the transverse axis 42.

Also, it will be noted (still with reference to FIG. 6) that the lengthwise axis 62 of each of the slots 30 is parallel to its related bend line 36, so that in the plan view of FIG. 6, this alignment axis 62 has the same slant to the transverse axis 42 as the bend line 36.

Figure 4:
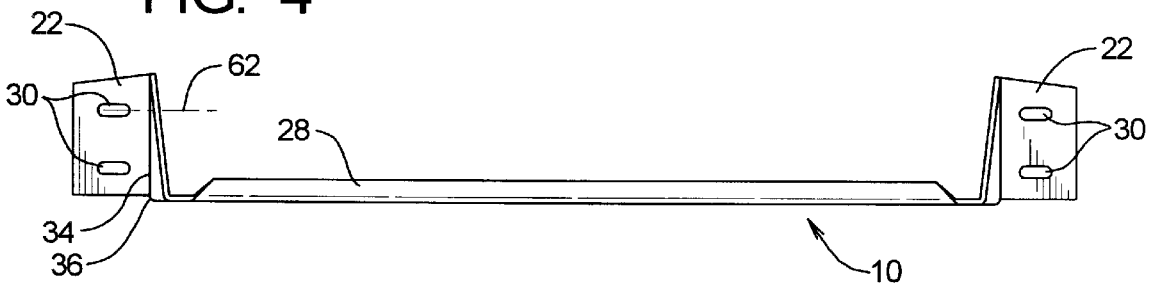
FIG. 4 is s front elevational view of the shelf section of FIG. 3.
Figure 5:
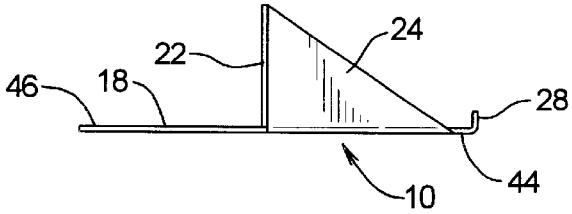
FIG. 5 is a side elevational view of the shelf section shown in FIGS. 3 and 4.
Figure 7:
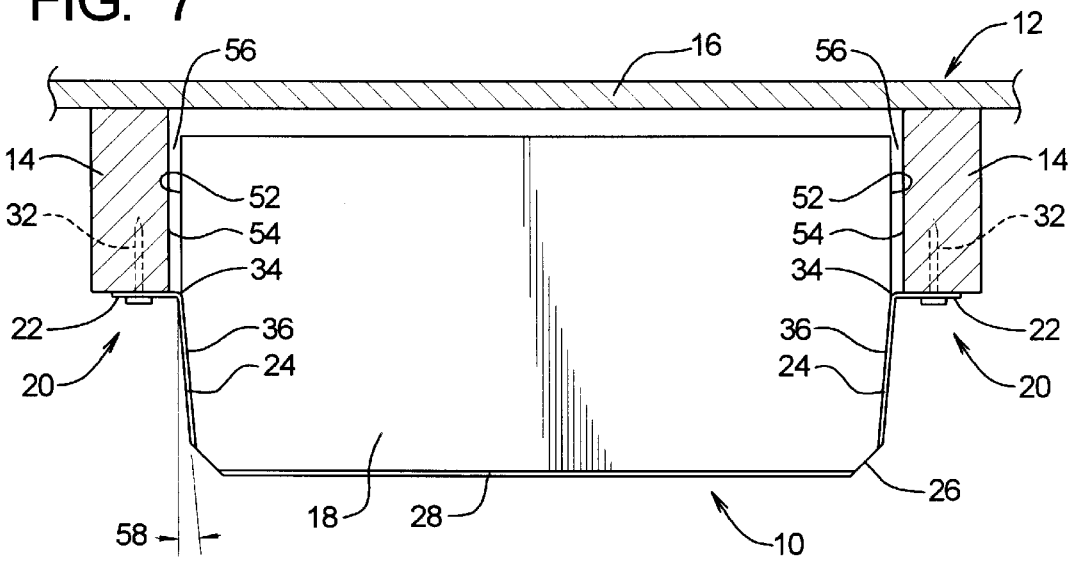
FIG. 7 is a top plan view, partly in section, similar to FIG. 3 showing the shelf section mounted to the 2×4s and adjacent to a vertical wall, with the wall, and with the 2×4s also being shown in section, and also showing in the broken lines the nails or screws used to mount the section.

In the shaping of the "laid-flat" shelf section of FIG. 6 to the finished shelf section of FIGS. 1 and 7, the flanges at 22 are each bent 90 degrees along the related bend line 34; each brace member 24 is rotated 90 degrees along its bend line 36, and the front lip 26 is bent 90 degrees along its bend line at 26. With that being accomplished, let us now look at the end configuration of the shelf member 10, and specifically examine FIGS. 3, 4, and 5 where the positional and angular relationships of the finished shelf section 10 can be seen more clearly.

First, as can be expected, the bracing member 24 which has been rotated upwardly to a vertical direction has its bottom bend line 36 forming the same angle at 58 (see FIG. 3) with the rear lateral edge 52 of the rear platform section 46. On the other hand, the bend line 34, where the flange 22 joins the bracing member 24, becomes vertically oriented so that it is perpendicular to the plane occupied by the platform 18. (This can be seen clearly in FIGS. 3, 4, and 5.) Also, it can be seen in viewing the right-hand part of FIG. 4 that the alignment axis 62 of each of the slots 32 is now horizontal (i.e. parallel to the plane occupied by the platform 18). Further, as can be seen in both FIGS 3 and 5, the planar alignment of the two flanges 22 is that each flange 22 lies in a vertical plane that is perpendicular to the plane of the platform 18 and is congruent with (laying in the same plane with) the transverse axis 42.

With these various relationships being established, let us now look at the benefits provided by the same. First, with regard to the positioning of the mounting flanges 22, it can be seen that the alignment of each mounting flange is such that when it is placed against and fixedly attached to the front surface 63 of the 2×4 posts 14, the platform 18 is horizontally aligned. Also, it will be noted that the slots 30 are horizontally aligned. Therefore, if there is any lateral adjustment needed because of possible misalignment of the 2×4s or for other reasons, this lateral adjustment could be made in a plane parallel to the platform 18.

Figure 9:
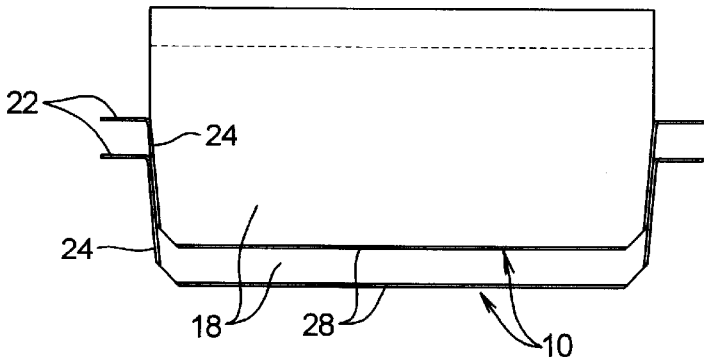
FIG. 9 is a top plan view showing two of the shelf sections of FIG. 1 being stacked in a nested arrangement.

Now we look at the slant of the bracing members 24. With the bracing members 24 being bent along the slanted bend line 36, effectively the forward portion 44 of the platform 18 has its side edges (which are the bend lines 36) tapering inwardly in a forward direction along with the inward and forward slant of the connecting members 24. The effect of this is that the shelf sections 10 can be nested with one another as shown in FIG. 9, for storage, shipment, display at a counter location, etc.

Now with reference to FIG. 6, it will also be noted that in the "laid-flat" configuration, each rear lateral edge 52 of the platform 18 forms one side of an angle relative to the inside edge 64 of the flange 22 at approximately the same angle as the bend line 36. Thus, when the flange 22 is in its finished position extending in its laterally outward position (as in FIG. 1), this bottom edge 64 is aligned with the plane of the platform 18.

Figure 8:
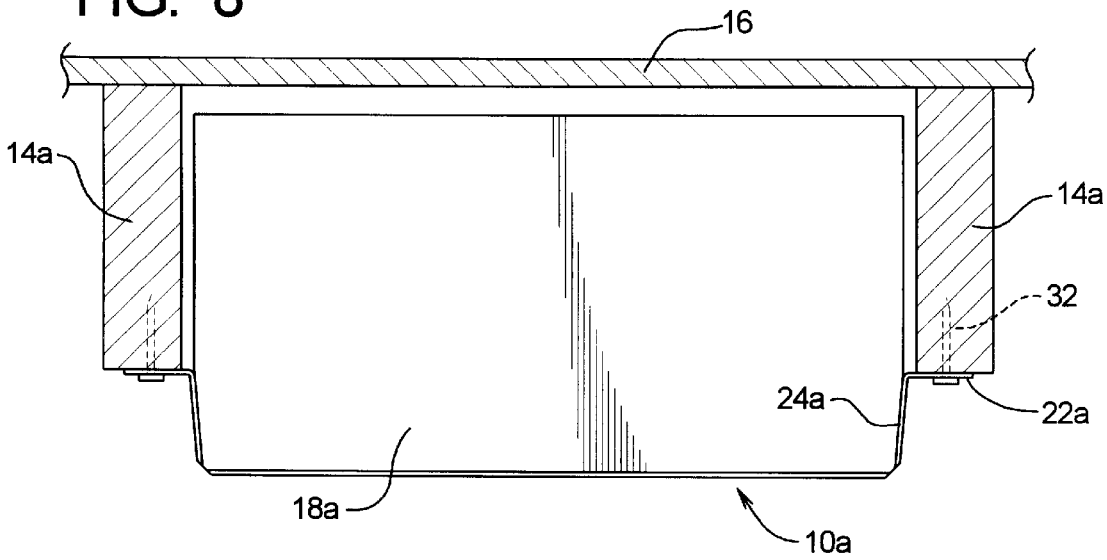

A second embodiment of the present invention is shown in FIG. 8. Components of this second embodiment which are similar to components of the first embodiment will be given like numerical designations, with an "a" suffix distinguishing those of the second embodiment. It can be readily seen by looking at FIG. 7 and FIG. 8, that the second embodiment of the shelf section 10*a* is substantially the same as the first embodiment of the shelf section 10, except that the shelf section 10*a* is sized so that it fits in the space between two post member 14*a* which (instead of being wooden 2×4s) are wooden 2×6s. Thus, with a greater depth dimension, the bend lines 34 and 36 of the first embodiment are positioned at a more forward location.

It is believed that the specific configuration, functional features, and method of shaping the laid-flat shelf section of the second embodiment are readily apparent from a reading of the description of the first embodiment. Accordingly, these will not be described in detail in the following text.

Figure 10:
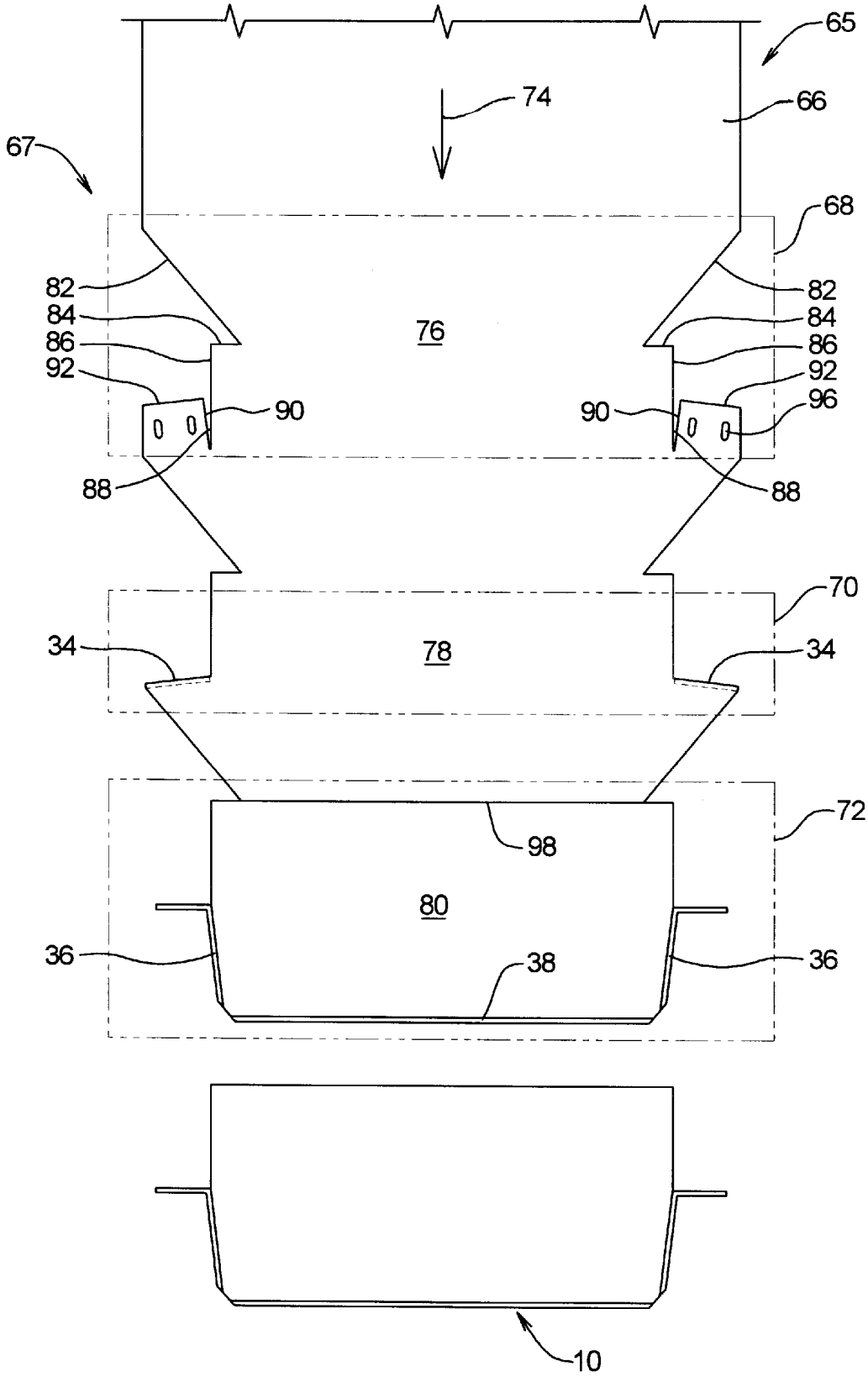
FIG. 10 is a somewhat schematic drawing illustrating a preferred method of manufacturing the shelf sections, showing a piece of sheet metal which is being directed into a forming and cutting section of a metal forming and cutting press, and showing the manufacturing sequence by which the three pre-forms are made into the end product.

Reference is now made to FIG. 10, which illustrates somewhat schematically the method of manufacture of the first embodiment of the present invention. It was indicated previously herein that one of the benefits of the present invention is that it readily lends itself to being manufactured both efficiently and economically. This will be described in the following text with reference to FIG. 10.

In this manufacturing operation, there is a large roll of sheet metal 65, and the free end portion 66 of the roll of sheet metal is unrolled from this roll and directed into the forming and cutting stamping die section (generally designated 67) of the forming and cutting press. The forming/cutting section comprises three operating subsections which are designated 68, 70, and 72, and which perform forming and/or cutting operations. Since the basic configuration of the forming and cutting apparatus already exists in the prior art, it is not illustrated herein, and the subsections 68, 70, and 72 are shown only schematically to indicate their locations at which they are performing their functions. The finished shelf section 10 is shown located at the end location after the last subsection 72.

To explain the manufacturing process, this is a progressive stamping process where each portion of the sheet metal passes through three stamping stations. We begin at the right side of FIG. 10, and there is an arrow 74 indicating the forward direction of travel of the sheet metal end portion 66. In operation, the sheet metal 66 moves forward one increment of travel, stops for a forming/cutting operation, moves through a second increment of travel, etc. Each time after the sheet metal 66 has stopped, the three forming/cutting subsections 68, 70, and 72 move down simultaneously to perform their respective forming/cutting operations. Then all three subsections 68, 70, and 72 are raised simultaneously, the sheet material is moved one increment of travel further forwardly, and again the three forming/cutting subsections 68, 70, and 72 move downwardly to perform their operations. This continues until the entire roll of sheet metal has been formed into the shelf sections 10. There are produced in this forming/cutting operation three different preform sections indicated at 76, 78 and 80, which are formed and/or cut by, respectively, the three cutting/forming subsections 68, 70, and 72.

To describe the operation, let us assume that the forming/cutting operation has just been completed, and that the subsections 68, 70, and 72 have just been raised. At the subsection of 68, the first preform section 76 is made with cuts along lines 82, 84, 86, 88, 90, 62, and 92. Further, the slots at 66 had been cut out.

Now let us look at the middle pre-form section 78. At the same time that the various cuts and punching has taken place to make the preform section 76, the pre-form section 78 has had the two flange sections 22 bent downwardly along the bend line 34 by the action of the second forming and/or cutting subsection 70.

Next, we go to the third subsection 72 where the final pre-form section 80 is located and is being formed. At this subsection 72 is lowered, a cut is made at 98. Further, the bends are made along the bend lines at 36 and at 38 (see FIG. 6 for the location of these bend lines). With the last forming/cutting operation being accomplished at the subsection 72, the pre-form 80 is in the configuration of the end product, which is the shelf section 10. Then the completed shelf section 10 is moved out of the forming/cutting section 67.

Figure 11:
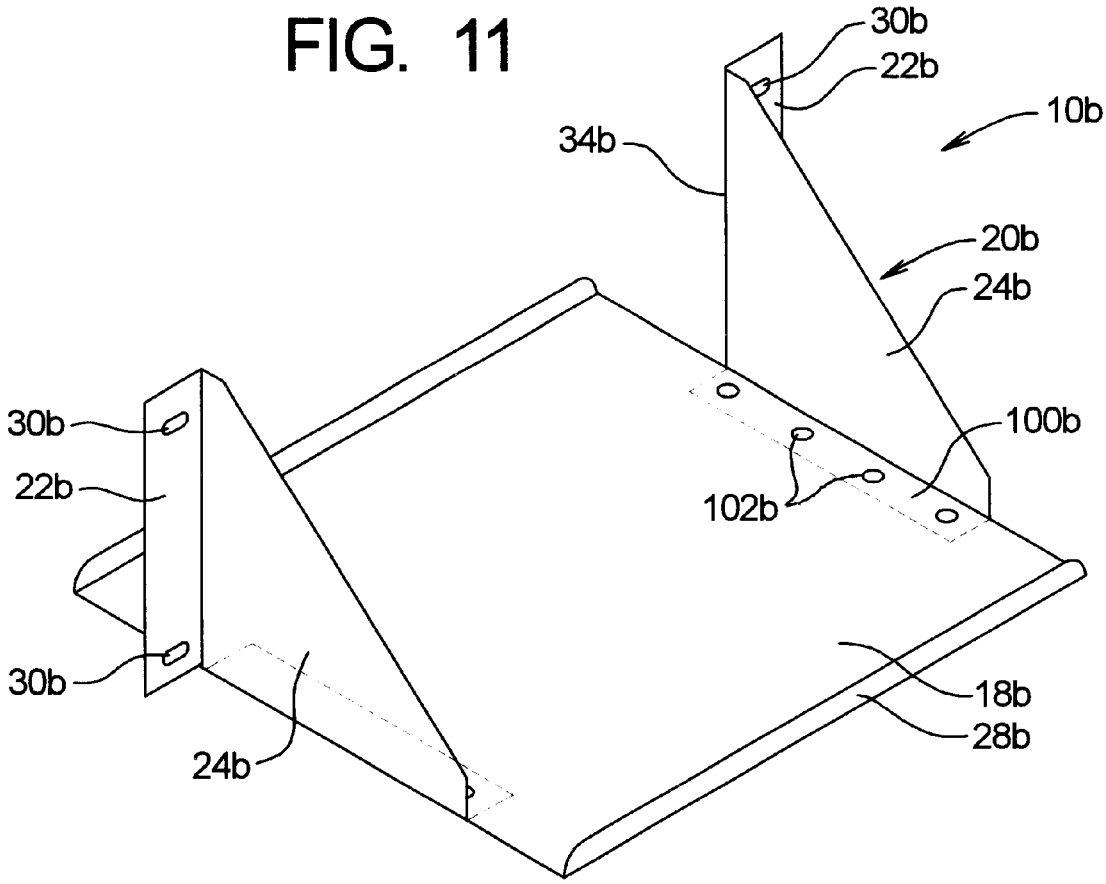
FIG. 11 is an isometric view showing a modified form of the present invention, where the shelf section is made of three separate pieces which are fixedly joined to one another.
Figure 12:
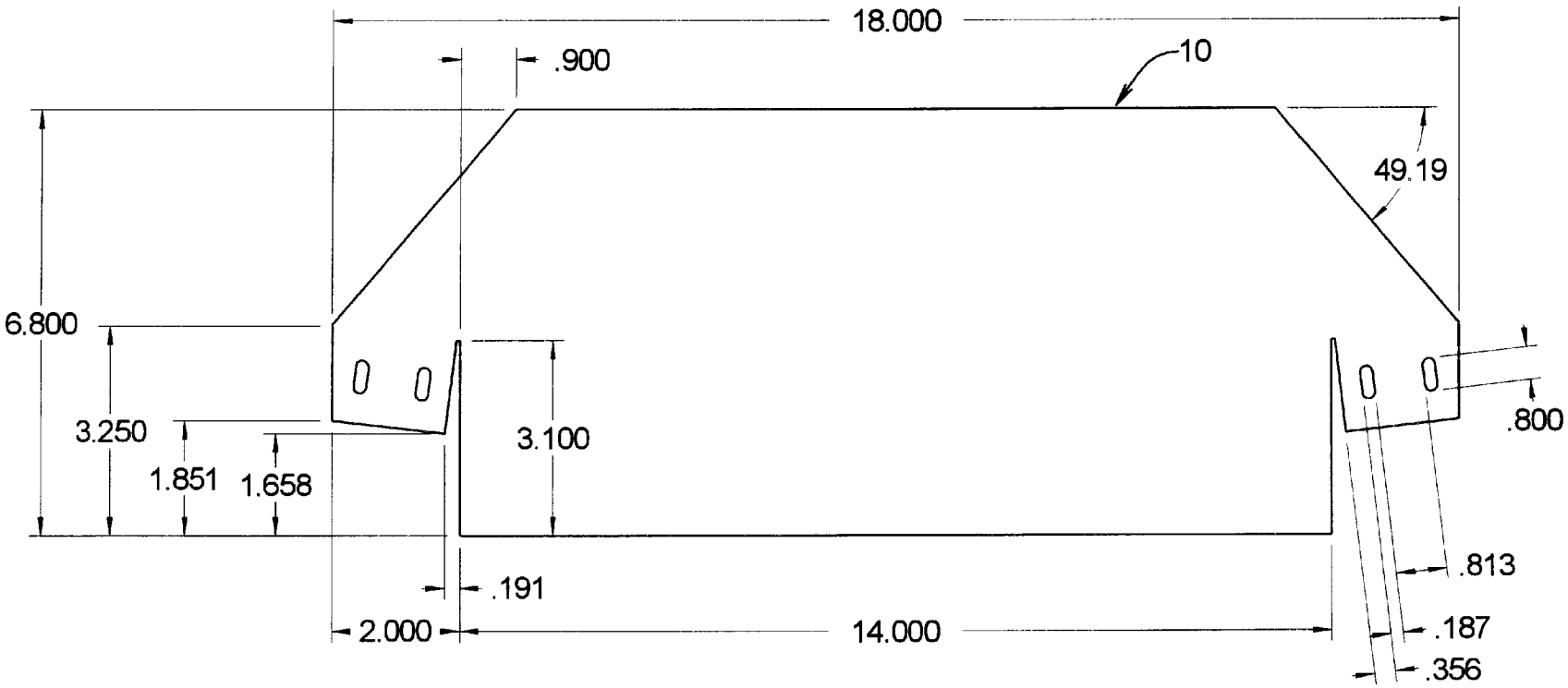
FIG. 12 is a "laid-flat" view (drawn to scale) which shows the same "laid-flat" section of FIG. 6, which is adapted to be mounted to wooden 2×4s, and showing the various dimensional and angular relationships.
Figure 13:
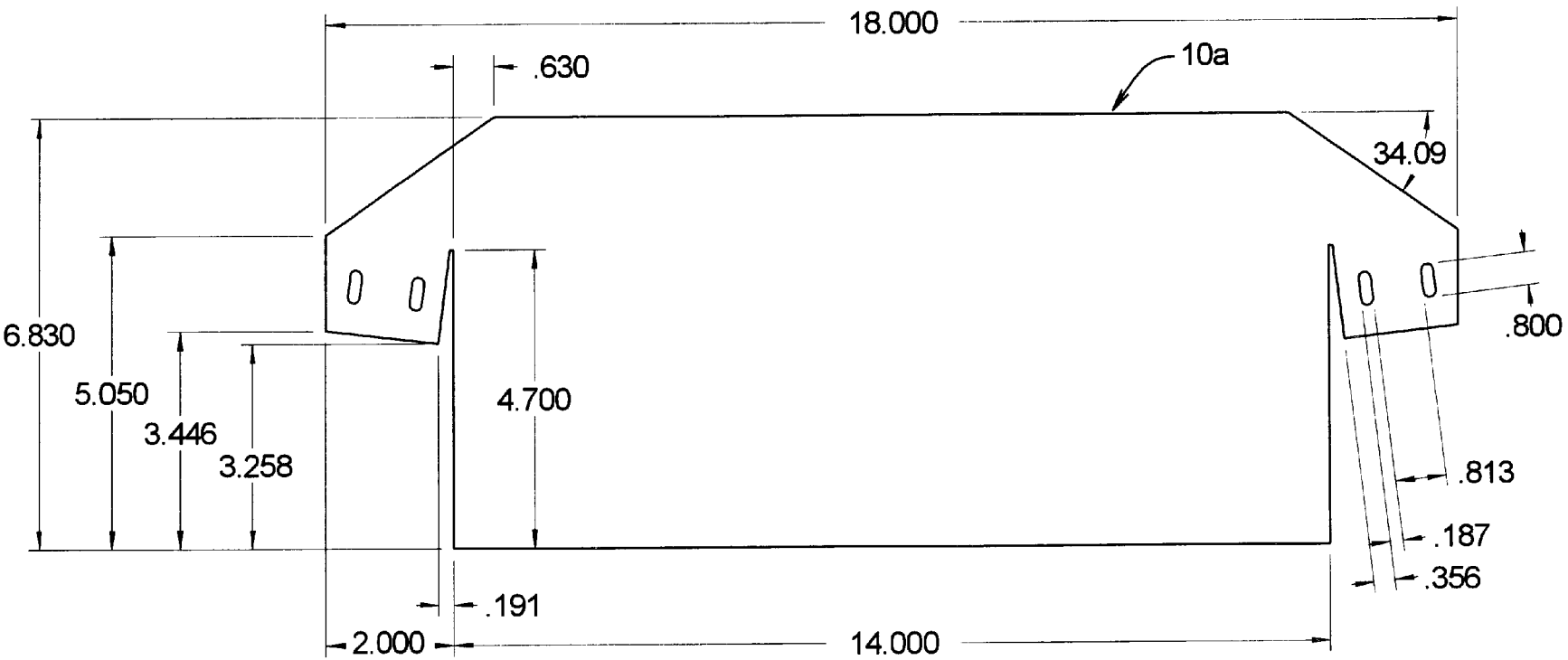
FIG. 13 is a "aid-flat" view similar to those of FIGS. 6 and 12, but showing the relative dimensions and angular relationships of the shelf section of FIG. 8, which is adapted to be mounted to two wooden 2×6 boards.

FIG. 11 shows a third embodiment of the present invention. Components of this third embodiment which are similar to components of the prior two embodiments will be given like numerical designations with a "b" suffix distinguishing those of the third embodiment. It is readily apparent from observing FIG. 11 that there are the same basic components of the prior two embodiments, so that the shelf section 10*b* has the platform 18*b*, the two mounting flanges 22*b*, the connecting members 24*b*, and the forward lip 28*b*. Also, there is a bend line 34*b* between the flange 22*b* and the bracing member 24*b*.

However, instead of connecting the bracing member 24*b* to the platform 18*b* as part of a single integral member, with the juncture being made at a bend line, there is instead provided for each bracing member 24*b* a laterally extending flange 80*b* which extends from the lower edge of the bracing member 24*b* laterally inwardly beneath the platform 18*b*. Suitable fasteners are indicated at 102*b*, and there could be rivets, welds, or some other bonding operation. It will be noted that this third embodiment is not configured so as to have the benefit of being able to have a plurality of these shelf sections 10*b* stacked in nesting fashion. Nevertheless, within the broader scope of the present invention, this third embodiment may have certain applications where it could be used quite advantageously.

It is to be recognized that various modified embodiments of the present invention could be made, and also that the particular orientation of components could be changed. For example, the angular relationships of the bend lines 34 and 36 of the first embodiment could be modified to increase or decrease the angles of orientation. Increasing the angle 58 would improve the nesting capability since the shelf members 10 could be positioned more closely to one another. However, the downside of this would be that there would be moderately less shelf space in the forward part of the platform 18. Also, the claims are to be interpreted to cover not only this specific configuration along with the dimensions, but also to be interpreted to cover alternate configurations and equivalent structures.

Therefore I claim:

1. A shelf section adapted to be connected to two posts, with each post having a front surface and a lateral surface, and with the lateral surfaces facing each other, said shelf section comprising:

a) a platform having front and rear platform portions and oppositely positioned side platform edge portions, a front-to-rear longitudinal axis, and a transverse axis, with this platform being arranged so that in an operating position, a rear portion of the platform is positioned between the two posts with rear side edge portions of the platform being adjacent to the posts and the front platform portion extends forwardly of the posts;

b) a pair of mounting flanges, located on opposite sides of the shelf section and positioned in a manner that with the shelf section in the operating position, the mounting flanges are located at an intermediate location between the front and rear platform portions so as to be adjacent to the respective front surfaces of the posts so as to be able to be connected thereto;

c) a pair of bracing members located on opposite sides of the platform, each bracing member connecting between one of said pair of mounting flanges at a rear connecting location spaced vertically from the platform and at a forward connecting location at a forward side edge portion of the platform, whereby the shelf section can be positioned in the operating position with the rear platform portion being located between the two posts, and being properly mounted to the posts by means of the two flanges in a manner which loads on the platform are supported by the flanges at said intermediate location.

2. The shelf section as recited in claim 1, wherein a forward portion of the platform has front side edges which extend in a forward and inward direction toward the longitudinal center axis, and the two bracing members are each attached to the converging forward side edge portions of the platform, and extend upwardly therefrom and join to the related flange members, whereby a plurality of shelf members can be stacked together in nesting relationship with related forward portions of the shelf members nesting with one another.

3. The shelf section as recited in claim 2, wherein each bracing member has a lower edge portion connected to a related forward side edge portion of the platform, and a vertical rear edge by which the bracing member connects to a vertical connecting edge of its related flange.

4. The shelf section as recited in claim 3, wherein said shelf section is an integral structure formed from a generally planar piece of sheet metal, and the sheet metal has bend lines corresponding to connecting lines between the two bracing members and the platform, and also corresponding to vertical connecting lines between the two bracing members and the two flange members, with the bracing members and the flange members having a bent configuration along the bend lines so that the bracing members extend generally vertically upwardly from the platform, and the two flange members lie generally in a vertical laterally aligned plane.

5. The shelf section as recited in claim 1, wherein the shelf section is made as a integral structure, and is formed from a flat piece of sheet metal, having side portions functioning as said bracing members and bent along bend lines so as to be extending vertically upwardly from the platform, and with the two flange members being bent along bend lines connecting to the bracing members and extending laterally therefrom.

6. A shelf section adapted to be connected to two posts, with each post having a front surface and a lateral surface, and with the lateral surfaces facing each other, said shelf section comprising:

a) a platform having front and rear platform portion and oppositely positioned side platform edge portions, a front-to-rear longitudinal axis, and a transverse axis, with this platform being arranged so that in an operating position, at the rear portion of the platform is positioned between the two post and the front platform portion extends forwardly of the posts;

b) a pair of mounting flanges, located on opposites sides of the shelf section and positioned in a manner that with the shelf section in the operating position, the mounting flanges are located at an intermediate location between the front and rear platform portions so as to be adjacent to the respective front surfaces of the posts so as to be able to be connected thereto;

c) a pair of bracing members located on opposite side of the platform, each bracing member connecting between a related flange at a rear connecting location spaced vertically from the platform and at a forward connecting location at a forward side edge portion of the platform;

d) said shelf section being characterized in that the platform, the mounting flanges, and the bracing members are formed into the shelf section from a single piece of preform sheet metal which has a preform configuration which comprises:

i) a rear generally rectangularly shaped planer preform platform portion with longitudinally extending rear side edges spaced laterally from one another at a spacing distance equal or nearly equal to a distance between adjacent lateral surfaces of adjacent post so as to be able to fit between and adjacent to said adjacent lateral surfaces;

ii) a forward generally planar preform platform portion which has a front end edge portion and two side forward platform bend lines which extend from rear edge portion of the forward generally planar preform platform portion in a forward direction;

iii) two bracing preform portions, each having a platform connecting portion at a related one of the side forward platform bend lines;

iv) two flange preform portions, each of which has a bracing bend line at which a flange perform portion connects to a related one of the bracing preform portions;

v) each of said bracing bend lines being perpendicular to a related one of said forward platform bend lines;

e) said preform sheet metal being formed by bending the two flange preform portions substantially ninety degrees about its related bracing bend line, and bending each bracing preform portion substantially ninety degrees about its related forward platform bend line.

7. The shelf section as recited in claim 6 wherein said two side forward portion bend lines converge toward one another in a forward direction and the two bracing bend lines are each perpendicular to its related side forward platform bend line, so that the shelf section can be stacked in nesting relationship.

* * * * *